United States Patent [19]

Farley et al.

[11] 3,976,136

[45] Aug. 24, 1976

[54] PRESSURE OPERATED ISOLATION VALVE FOR USE IN A WELL TESTING APPARATUS AND ITS METHOD OF OPERATION

[75] Inventors: David L. Farley; Robert T. Evans, both of Duncan, Okla.

[73] Assignee: Halliburton Company, Duncan, Okla.

[22] Filed: June 20, 1975

[21] Appl. No.: 588,991

[52] U.S. Cl. ..... 166/264; 166/315; 166/224 A; 166/.5

[51] Int. Cl.[2] ..... E21B 33/10; E21B 47/00

[58] Field of Search ..... 166/264, 315, 250, 224 R, 166/224 A, .5, 152, 162, 184, 185

[56] References Cited

UNITED STATES PATENTS

| | | | |
|---|---|---|---|
| 2,951,536 | 9/1960 | Garrett | 166/224 A X |
| 3,410,346 | 11/1968 | Garrett et al. | 166/53 |
| 3,459,264 | 8/1969 | Olson et al. | 166/250 |
| 3,500,911 | 3/1970 | Farley et al. | 166/250 |
| 3,664,415 | 5/1972 | Wray et al. | 166/.5 |
| 3,696,868 | 10/1972 | Taylor, Jr. | 166/224 A |
| 3,717,203 | 2/1973 | Kirkpatrick et al. | 166/224 A |
| 3,827,494 | 8/1974 | Crowe | 166/224 A |
| 3,856,085 | 12/1974 | Holden et al. | 166/264 |
| 3,858,649 | 1/1975 | Wray et al. | 166/264 X |

*Primary Examiner*—Stephen J. Novosad
*Attorney, Agent, or Firm*—Floyd A. Gonzalez; John H. Tregoning

[57] ABSTRACT

In a well testing tool having a spring whose biasing force is supplemented by the hydrostatic pressure in the well annulus at the testing depth, a method and apparatus for isolating the spring from the pressure in the well annulus utilizing the pressure differential between the well annulus and the testing tool bore which exists after the formation is isolated. An insolation valve is provided whose closing force is generated by isolating the testing tool bore from the well annulus, and then increasing the well annulus pressure above the hydrostatic pressure. The pressure differential thus created is utilized to close the valve. The opening force is generated by compressing a spring as the valve is closed. Thus, an isolation valve is provided which is normally open and which closes only after the well annulus pressure exceeds a reference pressure trapped in the bore of the testing tool by a predetermined amount.

15 Claims, 4 Drawing Figures

Figure 3:
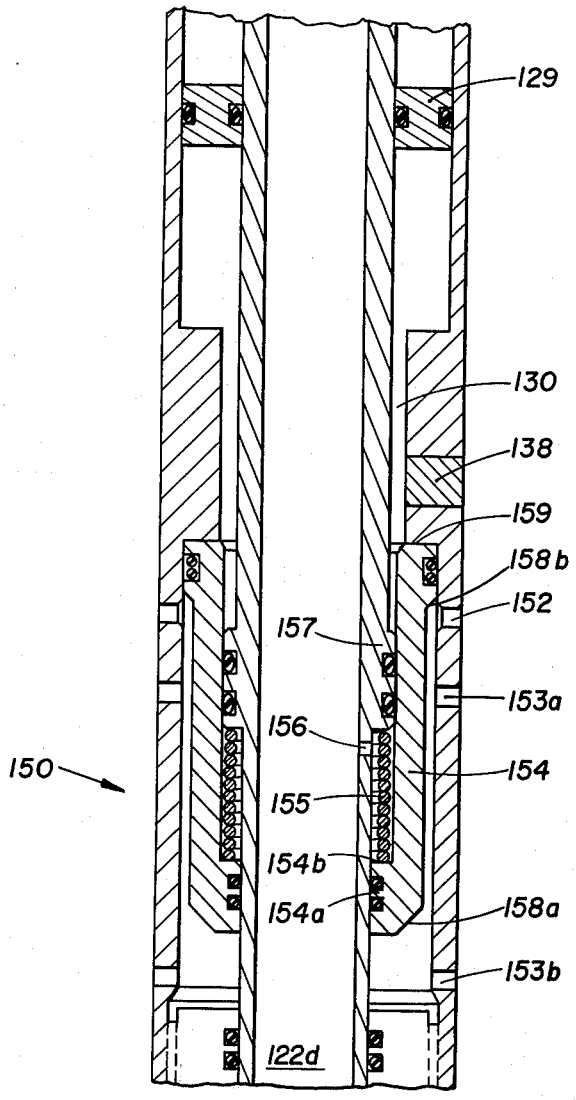

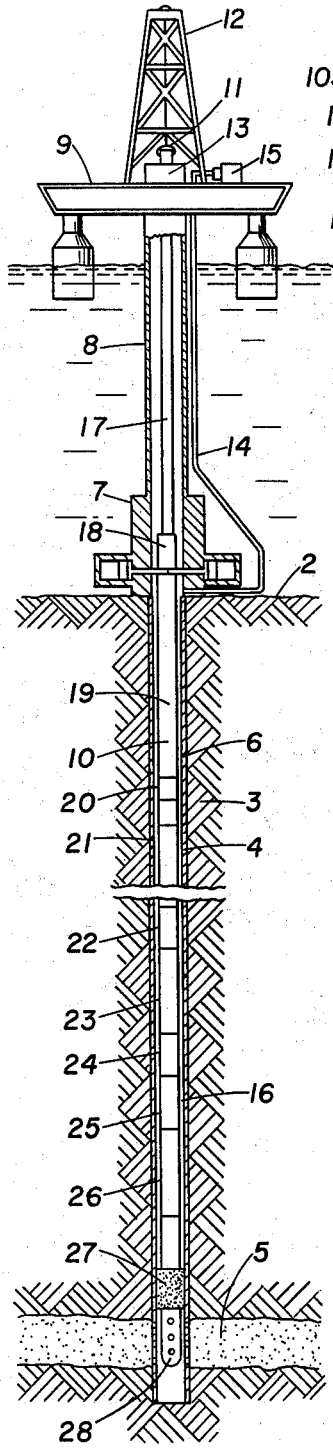
FIG. 1
FIG. 2a
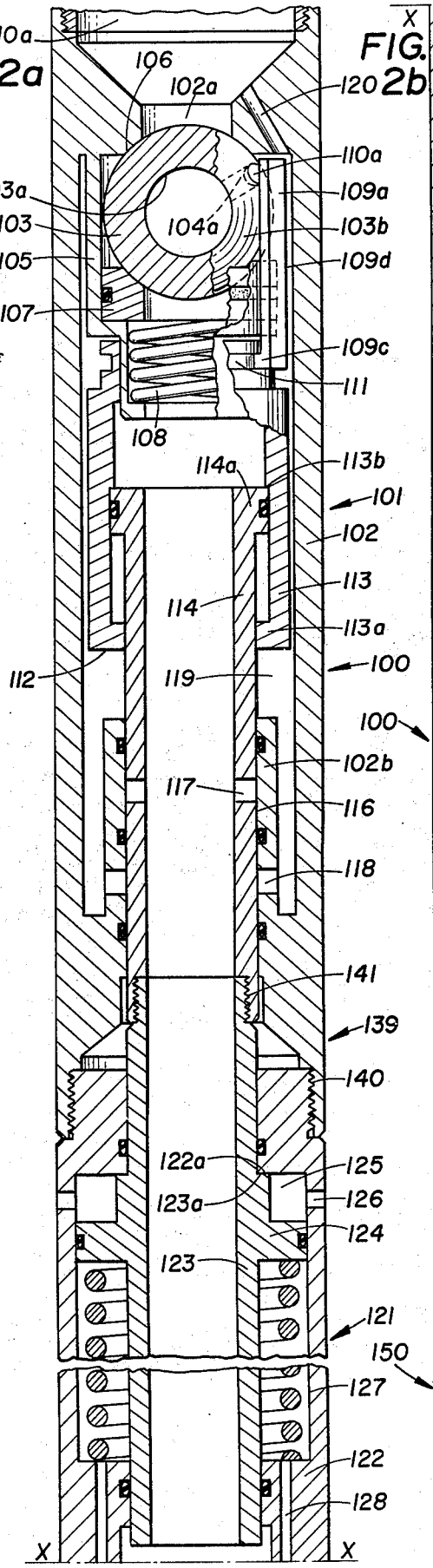
FIG. 2b
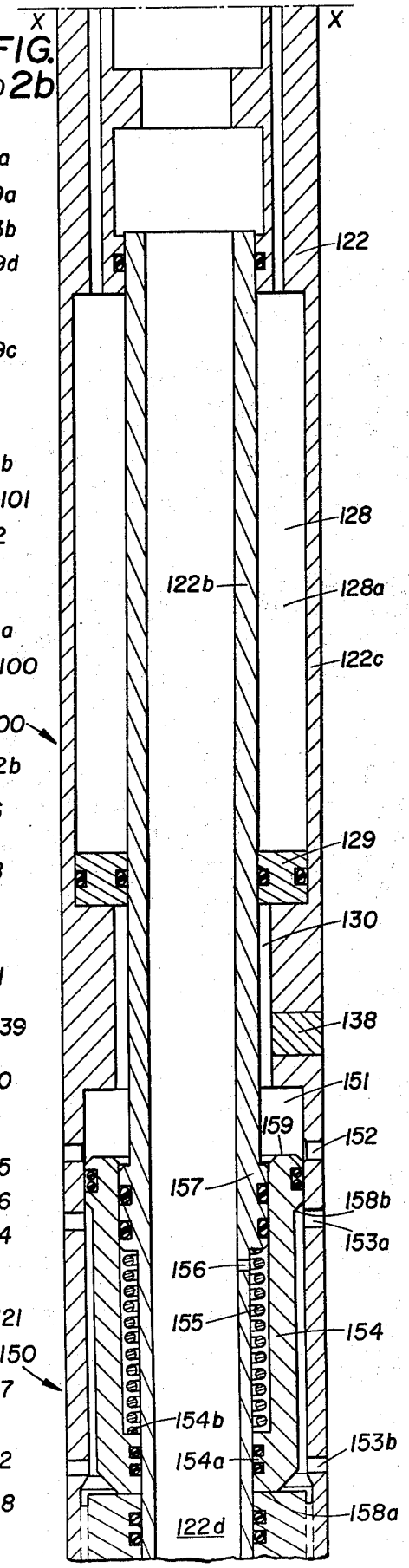

PRESSURE OPERATED ISOLATION VALVE FOR USE IN A WELL TESTING APPARATUS AND ITS METHOD OF OPERATION

BACKGROUND AND SUMMARY OF THE INVENTION

The invention herein disclosed pertains to a method and apparatus for testing the productivity of formations which contain petroleum products. The invention is particularly useful in the testing of offshore wells where it is desirable to conduct a testing program with a minimum of testing string manipulation, and preferably with the blowout preventers closed during a major portion of the program.

It is known in the art that sampler valves and tester valves for testing the productivity of oil wells may be operated by applying pressure increases to the fluid in the annulus of the well. For instance, U.S. Pat. No. 3,664,415 to Wray et al. discloses a sampler valve which is operated by applying annulus pressure increases against a piston in opposition to a predetermined charge of inert gas. When the annulus pressure overcomes the gas pressure, the piston moves to open a sampler valve thereby allowing formation fluid to flow into a sample chamber contained within the tool, and into the testing string facilitating production measurements and testing.

U.S. Pat. No. 3,858,649 to Holden et al. also discloses a sampler apparatus which is opened and closed by applying pressure changes to the fluid in the well annulus. This apparatus contains a supplementing means wherein the inert gas pressure is supplemented by the hydrostatic pressure of the fluid in the well annulus as the testing string is lowered into the borehole. This feature allows the use of lower inert gas pressure at the surface and provides that the gas pressure will automatically be adjusted in accordance with the hydrostatic pressure and environment at the testing depth, thereby avoiding complicated gas pressure calculations required by the earlier devices for proper operation. U.S. Pat. No. 3,856,085 to Holden et al. likewise provides a supplementing means for the inert gas pressure in a full opening testing apparatus.

The above mentioned supplementing means includes a floating piston exposed on one side to the inert gas pressure and on the second side to the annulus pressure in order that fluid pressure in the annulus can act on the gas pressure. The system is balanced to hold the valve in its normal position until the testing depth is reached. Upon reaching the testing depth, the floating piston is isolated from the annulus pressure so that subsequent changes in the annulus pressure will operate the particular valve concerned.

The prior method of isolating the floating piston has been to close the flow channel from the annulus to the floating piston with a valve which closes upon the addition of weight to the string. This is done by setting the string down on a packer which supports the string and isolates the formation during the test. The prior apparatus is designed to prevent the isolation valve from closing prematurely due to increasingly higher pressures as the test string is lowered into the well, contains means to transmit the motion necessary to actuate the packer mentioned above, and is designed to remain open until sufficient weight is set down on the packer to prevent premature isolation of the gas pressure and thus premature operation of the tester valve being used.

The present invention comprises a method for isolating the gas pressure from the fluid pressure in the annulus responsive to an increase in the annulus pressure by a predetermined amount above a reference pressure for use in an annulus pressure operated tool, wherein the operating force of the tool is supplied by the pressure of a gas in an inert gas chamber in the tool. The reference pressure used is the pressure which is present in the annulus at the time a well bore sealing packer is set.

The annulus pressure is allowed to communicate with an interior bore of the disclosed apparatus as the testing string is lowered in the well bore. This pressure is trapped as the above mentioned reference pressure when the packer seals off the well bore and isolates the formation to be tested. Subsequent increases in the well annulus pressure above the reference pressure activates a pressure responsive valve to isolate the inert gas pressure from the well annulus pressure. Additional pressure increases in the well annulus causes the well testing apparatus to operate in the conventional manner.

The invention disclosed simplifies the design and construction of the well testing apparatus. The resulting isolation valve is simple and has a minimum number of parts. The testing apparatus utilizing the invention of this disclosure will not have a discontinuity in its housing such as a collapsing section used to close the previously known isolating valves. A simplified isolating valve thus results which does not require special provision to transmit the movement necessary to set the packer, nor to support the forces of the drill string during the lowering or withdrawal of the test string in the borehole.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly in position in a submerged well bore and extending upwardly to a floating operating and testing station.

FIGS. 2*a*and 2*b*, joined along section line *x—x*, provides a "vertically sectioned" elevational view of the preferred embodiment incorporated into a full opening testing valve assembly with the disclosed isolation valve in the open position.

FIG. 3 provides a "vertically sectioned" elevational view of a portion of a testing valve assembly showing the preferred embodiment of the disclosed isolation valve in the closed position.

OVERALL WELL TESTING ENVIRONMENT

During the course of drilling an oil well the borehole is filled with a fluid known "drilling fluid" or "mud." One of the purposes, among others, of this drilling fluid is to contain in the intersected formations any fluid which may be found there. This is done by weighting the mud with various additives so that the hydrostatic pressure of the mud at the formation depth is sufficient to keep the formation fluid from escaping from the formation out into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus "closing-in" the formation from changes in the hydrostatic pressure of the drilling fluid.

The valve at the lower end of the testing string is then opened and the formation fluid, free from the restraining pressure of the drilling fluid, can flow into the interior of the testing string.

The testing program includes periods of formation flow and periods when the formation is "closed-in." Pressure recordings are taken throughout the program for later analysis to determine the production capabilities of the formation. If desired, a sample of the formation fluid may be caught in a suitable sample chamber.

At the end of the testing program, a circulation valve in the test string in opened, formation fluid in the testing string is circulated out, the packer is released, and the testing string is withdrawn.

In an offshore location, it is desirable to the maximum extent possible, for safety and environmental protection reasons, to keep the blowout preventers closed during the major portion of the testing procedure. For this reason testing tools which can be operated by changing the pressure in the well annulus surrounding the testing string have been developed.

FIG. 1 shows a typical testing string being used in a cased, offshore well. The testing string components, and the reference numbers used are the same as those shown in aforesaid U.S. Pat. Nos. 3,664,415 to Wray et al, and 3,856,085 to Holden et al.

By way of summary, the environment may include:

| REFERENCE NUMERALS COMMON TO PRESENT DISCLOSURE AND WRAY ET AL PATENT 3,664,415 | ITEM OF ILLUSTRATED CONTEXT |
|---|---|
| 1 | Floating drilling vessel or work station |
| 2 | Submerged well site |
| 3 | Well bore |
| 4 | Casing string lining well bore 3 and having perforations communicating with the formation |
| 5 | Formation, the productivity of which is to be tested |
| 6 | Interior of well bore 3 |
| 7 | Submerged well head installation including blowout preventer mechanism |
| 8 | Marine conductor extending between well head 7 to work station 1 |
| 9 | Deck structure on work station 1 |
| 10 | Formation testing string (i.e., assembly of generally tubular components extending between formation 5 and work station 1 and passing through marine conductor 8 and well bore 3) |
| 11 | Hoisting means supporting testing string 10 |
| 12 | Derrick structure supporting hoisting means 11 |
| 13 | Well head closure at upper end of marine conductor 8 |
| 14 | Supply conduit for fluid operable to transmit fluids such as mud to interior 6 of well bore beneath blowout preventers of installation 7 |
| 15 | Pump to impart pressure to fluid in conduit 14 |
| 16 | Annulus surrounding testing string 10 formed when testing string 10 is placed into well bore 3 |
| 17 | Upper conduit string portion extending to work site 1 (usually threadably interconnected conduit sections) |
| 18 | Hydraulically operated, conduit string "test tree" |
| 19 | Intermediate conduit portion |
| 20 | Torque transmitting, pressure and volume balanced slip joint |
| 21 | Intermediate conduit portion for imparting packer setting weight to lower portion of string |
| 22 | Circulating valve |
| 23 | Intermediate conduit portion |
| 24 | Upper pressure recorder and housing |
| 25 | Valving mechanism |
| 26 | Lower pressure recorder and housing |
| 27 | Packer mechanism |
| 28 | Perforated "tail pipe" providing fluid communication between interior of testing string 10 and formation 5 |

Details of components 1 through 28 and other possible components and aspects of their incorporation in the aforesaid installation as depicted in FIG. 1 are set forth in detail in columns 3 through 6 of the aforesaid Wray et al. U.S. Pat. No. 3,664,415, the entire disclosure of which is herein incorporated by reference so as to avoid the necessity for redescribing this representative testing environment.

In columns 3 through 5 of the aforesaid Wray et al. patent, reference is made to patents depicting details of various components of this representative content of the invention and reference is also made to U.S. patent applications depicting certain of these components. The Anderson et al. application Ser. No. 829,388 for a desirable packer as identified in column 4 of the Wray et al. patent has now issued as U.S. Pat. No. 3,584,684 June 15, 1971. Similarly, the Manes et al. application Ser. No. 882,856 referred to in columns 3, 4, 5, and 6 in relation to various components has now issued as U.S. Pat. No. 3,646,995 Mar. 7, 1972.

DESCRIPTION OF THE VALVING MECHANISM

The valving mechansim 25 shown in FIG. 1 may be similar to the oil well testing and sampling apparatus disclosed in U.S. Pat. No. 3,858,649 to Wray et al., or may be similar to the improved, full opening testing valve assembly disclosed in U.S. Pat. No. 3,856,085 to Holden et al. Portions of the preferred embodiment of FIG. 2 is similar to that disclosed in the aforesaid U.S. Pat. No. 3,856,085 to Holden et al., and the same reference numbers have been used where possible.

The overall valve assembly 100 shown in FIG. 2 includes a valve unit 101, an actuator or "power" unit 121, and a separable connecting means 139 which allows selective connection and disconnection of those two components. The isolation valve 150 of the invention is shown as a portion of the actuator unit 121.

By way of review, the valve unit 101 includes a generally tubular housing 102 having a longitudinally extending central flow passage **102*a* which is controlled by ball valve 103. When the ball valve 103 is oriented with its central passage 103*a* in the position shown in FIG. 2,** the flow passage 102*a* is blocked, and the valve is closed.

When the ball valve 103 is turned by the action of lugs 110*a* in recesses 104*a*, the ball is turned such that central passage 103*a* is aligned with flow passage 102*a* to give a fully open flow passage through the valve unit 101.

The ball valve is held in position by valve housing 105, by upper ball valve seat 106 and by lower valve seat 107. Coil spring 108 carried by housing 102 acts to bias the valve seats 106 and 107 and the ball valve 103 together.

The lugs 110*a* are carried by actuating arms 109*a* . Actuating arms 109*a* and pull sleeve means 112 are connected together by radially inwardly extending flange portion 109*c* of the actuating arms 109*a* fitted into a groove 111 provided in the upper end of pull sleeve means 112.

Pull sleeve means 112 is provided with lost motion means 115 to allow for some motion to occur without the ball valve 103 being activated. This is done by providing pull sleeve means 112 with an outer tubular component 113, and an inner telescoping sleeve component 114. Inner telescoping sleeve component 114 will move within outer tubular component 113 until mutually engageable means 113*a* and 114*a* are brought together.

This lost motion means is provided to allow the momentary opening of a bypass means 116 to reduce the pressure differential across the ball valve 103 before it is opened. The bypass means 116 includes a sleeve portion 102*b* of the housing 102 having ports 118, and ports 117 provided in inner sleeve portion 114 of the pull sleeve means 112. At the end of the stroke provided by the lost motion means 115, ports 117 are aligned with ports 118 to allow pressure below the ball 103 to communicate through the ports 117 and 118 into bypass passages 119 and 120 and finally to communicate with the flow passage 102*a* of the valve unit above the ball and with the interior 10*a* of the test string.

The actuator unit 121 is joined to the valve unit 101 by connection 139 and includes a tubular housing 122 having a flow passage 122*d* which communicates with the flow passage 102*a* of the valve unit. A tubular power mandrel 123 is telescopingly mounted in the housing 122 for longitudinal movement therein. An annular piston 124 is carried on the outer periphery of the power mandrel 123 and is received within and divides an annular chamber 125 provided in the housing 122. Shoulder portion 123a of the power mandrel 123 engages with surface 122*a* to limit the upward travel of power mandrel 123 in the annular cylinder 125.

The upper side of piston 124 is exposed to the fluid pressure in the annulus 16 surrounding the tool 100 through port 126. A coil spring 127 is provided in the lower portion of annular chamber 125 to oppose downward movement of the power mandrel 123.

The lower portion of the actuator housing 122 has an inner tubular mandrel 122*b*. Between the inner mandrel 122*b* and the lower housing 122*c* is an inert gas chamber 128 which is filled with compressed inert gas such as nitrogen. The inert gas chamber 128 communicates with chamber 125 and has an enlarged portion 128*a* which is divided by a floating piston 129. The upper side of floating piston 129 is exposed to the compressed nitrogen and the lower side is exposed to the fluid pressure in the annulus 16 which surrounds the tool assembly as long as the isolation valve remains open.

The operation of the above components is fully disclosed in columns 5–12 of the aforesaid U.S. Pat. No. 3,856,085 to Holden et al., the entire disclosure of which is herein incorporated by reference so as to avoid the necessity for redescribing their operation.

DESCRIPTION OF THE PREFERRED ISOLATION VALVE

The preferred isolation valve 150 controls the communication of the fluid pressure in the annulus 16 which surrounds the tool 100 with the lower side of floating piston 129. A chamber 151 is provided between the lower portion of actuator housing 122, and the inner tubular portion 122*b*. A flow passage 130 communicates chamber 151 with that portion of the inert gas chamber 128 which is below the floating piston 129.

Sleeve valve member 154 is located in chamber 151 between the outer wall of the actuator housing 122 and a thickened portion 157 of the inner tubular mandrel 122*b*. A coil spring 155 is located between the thickened portion 157 and a radially inwardly extending flange portion 154*a* of sleeve valve member 154. The outer, down facing surfaces 158*a* and 158*b* of the sleeve valve member is exposed to the fluid pressure in the annulus 16 through ports 153*a* and 153*b* provided in the lower portion of the actuator housing 122.

The upper surfaces 154*b* of flange portion 154*a* of the sleeve valve member 154 communicates with the interior bore 122*d* of the actuator housing 122 through ports 156 provided in the inner tubular mandrel 122*b*.

It can thus be seen that when sleeve valve member 154 is in the position shown in FIG. 2, well annulus pressure may communicate with and move floating piston 129 up until the pressure in inert gas chamber 128 and chamber 125 is sufficient to stop the movement. When sleeve valve member 154 is in its upper position as shown in FIG. 3, communication between the well annulus 16 and the floating piston 129 is blocked, and further increases in the annulus pressure will act on piston 124 to move the power mandrel down, thus pulling the pull sleeve means 112 to activate the bypass means 116 and open the ball valve 103.

A selectively operable disabling mechanism 138 is schematically represented in the lower wall of the actuator housing 122. This disabling mechansim is designed to provide communication between the well annulus 16 and the passage 130 in the event the pressure in the well annulus becomes excessive after the isolation valve 150 has been closed. This disabling means may comprise rupturable port means or openable valve means which is selectively operable by excessive well annulus pressure. Once disabling mechanism 138 is open, floating piston 129 may again move responsive to well annulus pressure to offset the effect of well annulus pressure acting on piston 124. When this happens, the power mandrel 123 will be forced upward by coil spring 127, and ball valve 103 will close.

The position, in FIG. 2, of disabling means 138 is more advantageous than that shown in aforesaid U.S. Pat. No. 3,856,085 because, should means 138 open, drilling fluid will not contaminate chamber 128, and inert gas will not be lost.

OPERATION OF THE INVENTION

When the testing string 10 is inserted and lowered into the well bore 3, the ball valve 103 is in the closed position. The packer allows fluid to pass during the descent into the well bore. It can thus be seen that the pressure in the interior bore 122*b* of the actuation unit 121, and that portion of the bore 102*a* below the ball 103 will be the same as the pressure in the well annulus 16 as the string is being lowered.

During the lowering process, the hydrostatic pressure in the annulus 16 and the interior bore 122d will increase. At some point, the annulus pressure will overcome the pressure of the inert gas in chamber 128, and floating piston 129 will begin to move upward. In this manner, the initial pressure given the inert gas in chamber 128 and the lower portion of chamber 125 will be "supplemented" to automatically adjust for the increasing hydrostatic pressure in the annulus, and other changes in the environment such as increased temperature.

It can be seen that as long as the packer is not set to seal off the well bore, the hydraulic forces acting on the sleeve valve member 154 will be in equilibrium. The pressure acting through ports 153*a*, 152, and 156 will all be equal. This pressure acting down on surfaces 159 and 154*b* will be balanced by the same pressure acting up on surfaces 158*a* and 158*b*. Coil spring 155 will act to hold sleeve valve member 154 in the down or open position.

When the packer is set to seal off the formation 5, the pressure in the interior bore 122*d* becomes independent and will no longer be controlled by the pressure in the well annulus. The pressure thus trapped in the interior bore 122*d* then becomes the reference pressure by which the valve is controlled.

At this time, the blowout preventer mechanism in the submerged well head installation 7 may be closed. Additional pressure above the hydrostatic pressure is then added to the drilling fluid in the well annulus. Since the pressure acting on the surface 154*b* of the sleeve valve member 154 remains at the reference pressure, the forces acting on the sleeve valve member 154 are no longer in equilibrium, resulting in a net hydraulic force "up." When the annulus pressure is raised sufficiently, this "up" force acting on sleeve member 154 will overcome the resisting force of the spring 155, and the sleeve valve member 154 will be moved to the closed position of FIG. 3.

The additional pressure added to the annulus to close isolation valve 150 will continue to act on floating piston 129 to further pressurize the inert gas in chambers 128 and 125. This additional pressure gives additional spring force to the inert gas to re-close ball valve 103. After the isolation valve is closed, additional pressure is added to the annulus to act on piston 124, and to operate ball valve 103 in the conventional manner.

At this time, the testing program is conducted. After the testing program is complete, the circulating valve 22 is operated as discussed above.

Before testing string 10 is raised from the well bore, it is desirable to reopen the isolation valve 150 in order that the inert gas in the actuator unit 121 can return to its initial pressure. It can be seen that as soon as the pressure in the annulus 16 and the interior bore 122*b* are returned to the hydrostatic value, the hydraulic pressures acting on surfaces 154*b*, 158*a* and 158*b* will again be equal. The pressure in channel 130 and acting on surface 159 will still be higher than hydrostatic pressure by the amount added to close valve 150. This downward force, along with the force of the coil spring 155 which was compressed when the valve closed, will move sleeve valve member 154 down to the open position. The inert gas pressure will now adjust itself by the action of floating piston 129 as the testing string is withdrawn from the well, until the initial inert gas pressure is reached.

While a preferred isolation valve 150 is shown in FIG. 2 in association with a full opening well testing apparatus, the disclosed isolation valve 150 can also be used in the actuator or power section of a sampling and testing apparatus of the type disclosed in U.S. Pat. No. 3,858,649 to Wray et al. This may be done by replacing the assembly 305 and the valve represented by the ports 306 of the power section 30 disclosed in U.S. Pat. No. 3,858,649 with the isolation valve 150 of the present invention. The apparatus would then be used in a configuration invented from that shown in order that the normally closed sampling and testing valve assembly 40 would be above the improved power section 30.

The above disclosed preferred embodiment having set forth the inventive concepts involved, it is the aim of the appended claims to cover all changes or modifications which may be envisioned by one familiar with this disclosure and which do not depart from the true spirit and scope of the invention.

What is claimed:

1. In a valve for use in an oil well testing string located in an oil well bore and having a packer arranged for selectively sealing the well bore isolating that portion of the oil well bore above the packer from that portion of the oil well bore below the packer, said valve having:

fluid containing means incorporated in the testing string for supplying operating force to testing apparatus located in the testing string; and, valve means incorporated in the testing string and having a normally open position and a closed position for controlling fluid communication between said fluid containing means and the oil well bore exterior of said testing string;

the improvement comprising pressure responsive operating means, operably connected to said valve means, for moving said valve means from the normally open position to the closed position responsive to a specified pressure increase in that portion of the well bore above the packer over the pressure in that portion of the well bore below the packer.

2. The valve of claim 1 further comprising:

biasing means, responsive to the operation of said pressure responsive operating means, for moving said valve means from the closed position to the normally open position upon equalization of the pressure in the well bore above the packer and below the packer.

3. In an apparatus for use in a tool string having a flow passage therethrough and lowered into a fluid filled well bore extending from the earth's surface to a subsurface formation thereby forming a well annulus between said tool spring and the walls of the well bore, wherein said apparatus includes:

a tubular housing having an interior bore communicating with the flow passage of the tool string;

normally closed valve means, within said tubular housing and operable by axial movement, for opening and closing said interior bore;

pressure responsive piston means, operably connected to said valve means, for causing axial movement in said tubular housing responsive to changes in pressure in the well annulus, thereby effecting opening and closing of said valve means;

spring means, in said tubular housing, for supplying a return force for said pressure responsive piston means; and supplementing means, having a normally open pressure conducting means communicating with said well annulus, for supplementing said spring means responsive to pressure in said well annulus as the tool string is lowered into said well bore; the improvement comprising:

means, in the lower portion of said tool string, for selectively trapping a reference pressure after the tool string is lowered into said well bore; and isolating valve means, in said normally open pressure conducting means, for closing said pressure conducting means responsive to an increase of pressure in said well annulus above said reference pressure by a predetermined amount.

4. The apparatus of claim 3 wherein said reference pressure is a fluid pressure selectively trapped in said interior bore of said tubular housing.

5. The apparatus of claim 4 wherein said reference pressure trapping means additionally isolates said subsurface formation from said well annulus.

6. An apparatus, to be ued in conjunction with an oil well testing tool operable for closing-in and testing a well formation and having a bore therethrough and a spring biasing means whose spring force is increased responsive to an increase in fluid pressure external to said tool, comprising:

valve means, in the wall of said tool, movable from an open position, wherein increases in said external fluid pressure increases the spring force of said spring biasing means, to a closed position, wherein increases in said external fluid pressure are isolated from said spring biasing means; and pressure responsive piston means, connected to said valve means, for moving said valve means from said open position to said closed position responsive to an increase in the pressure external to said tool a predetermined amount above the pressure in the well adjacent to said closed-in formation.

7. The apparatus of claim 6 wherein said pressure adjacent said closed-in formation is selectively trapped in said oil well testing tool bore.

8. The apparatus of claim 7 further comprising a spring between the wall of said tool and said piston means for preventing movement in said piston means until said pressure increase raises said external pressure a predetermined amount above said reference pressure, and for returning said piston means to its initial position when said external pressure increase is removed.

9. A pressure responsive isolation valve for use in a fluid filled well bore, comprising:

a tubular body having a central bore therethrough, a valve chamber in the wall thereof, a first plurality of ports in the inner wall thereof for providing fluid communication between the central bore and the valve chamber, a second plurality of ports in the outer wall thereof for providing fluid communication between the well bore surrounding said tubular body and the valve chamber, and a fluid passageway in the wall thereof in communication with the valve chamber to be opened and closed in response to changes in the pressure of the fluid in said well bore;

valve means in the valve chamber for opening and closing said fluid passageway in response to axial movement; and piston means, operably connected to said valve means and having a first area in communication with said first plurality of ports and a second area in communication with said second plurality of ports, for moving said valve means in a first axial direction when the well bore pressure in communication with said second area is greater than the central bore pressure in communication with said first area.

10. The valve of claim 9 further comprising:

spring means between the wall of said tubular body and said piston means for preventing movement in the first axial direction until the well bore pressure in communication with said second area exceeds by a predetermined amount the central bore pressure in communication with said first area.

11. The valve of claim 10 wherein said central bore is normally in communication with the pressure of the fluid in said well bore, and further comprises means in said well bore for selectively isolating said central bore from the pressure of the fluid in said well bore.

12. A method of supplementing the spring force of a spring biasing means in an oil well testing tool, comprising the steps of:

a. communicating, through an open pressure responsive valve means, the pressure in the well annulus of an oil well with a spring supplementing means for supplementing said spring force responsive to said annulus pressure;

b. lowering the tool incorporated in a testing string into the well bore of said oil well, thereby supplementing said spring force responsive to the pressure in the well annulus;

c. closing-in a formation in said oil well, thereby isolating the pressure in that portion of the well bore adjacent said formation from the pressure in the well annulus;

d. increasing the pressure in the annulus above the pressure isolated in that portion of the well bore adjacent said formation; and e. closing said pressure responsive valve means responsive to the pressure differential between the well annulus and the pressure isolated in that portion of the well bore adjacent said formation, thereby isolating said spring supplementing means from the pressure in the well annulus.

13. The method of claim 12 comprising the additional step of applying additional pressure in the annulus to open a pressure responsive tester valve means in said oil well testing tool for providing communication between said formation and said testing string.

14. The method of claim 13 comprising the additional steps of:

reducing pressure in the well annulus, thereby opening said pressure responsive tester valve means in response to the supplemented spring force of said spring biasing means; and providing communication between the well annulus and that portion of the well bore adjacent said formation, thereby removing said pressure differential and opening said pressure responsive valve means.

15. A method of operating a valve in an oil well tool located in an oil well comprising the steps of:

selectively closing the well bore with a packer, thereby isolating the pressure in that portion of the well bore below the packer from that portion of the well bore above the packer;

increasing the pressure in that portion of the well bore above the packer for creating a pressure differential between that portion of the well bore above the packer and that portion of the well bore below the packer;

selectively moving a valve from a normally open position to a closed position responsive to said pressure differential;

selectively opening the packer, thereby establishing communication between that portion of the well bore above the packer and that portion of the well bore below the packer for removing said pressure differential; and moving said closed valve to the normally open position responsive to the removal of said pressure differential.

* * * * *